United States Patent [19]

Schlotterbeck

[11] 4,054,855

[45] Oct. 18, 1977

[54] ADJUSTABLE-INDUCTANCE ELECTRIC COIL

[75] Inventor: Max Schlotterbeck, Munich, Germany

[73] Assignee: Siemens Aktiengesellschaft, Berlin & Munich, Germany

[21] Appl. No.: 668,700

[22] Filed: Mar. 19, 1976

[30] Foreign Application Priority Data

Mar. 20, 1975 Germany ..... 2512309

[51] Int. Cl.[2] ..... H01F 21/06

[52] U.S. Cl. ..... 336/83; 336/136

[58] Field of Search ..... 336/83, 136, 130, 131, 336/135, 132, 134; 174/177

[56] References Cited

U.S. PATENT DOCUMENTS

| | | | |
|---|---|---|---|
| 2,905,913 | 9/1959 | Leigh | 336/83 |
| 3,254,319 | 5/1966 | Olsen et al. | 336/83 X |
| 3,262,079 | 7/1966 | Glover et al. | 336/83 X |
| 3,480,896 | 11/1969 | Newman | 336/83 |

FOREIGN PATENT DOCUMENTS

| | | | |
|---|---|---|---|
| 1,032,117 | 6/1953 | France | 174/177 |
| 980,263 | 5/1951 | France | 336/132 |
| 1,224,459 | 3/1971 | United Kingdom | 336/83 |
| 1,054,341 | 1/1967 | United Kingdom | 336/83 |
| 924,549 | 4/1963 | United Kingdom | 336/136 |

*Primary Examiner*—Thomas J. Kozma

*Attorney, Agent, or Firm*—Hill, Gross, Simpson, Van Santen, Steadman, Chiara & Simpson

[57] ABSTRACT

An electrical coil is formed from a core of magnetizable material and surrounding winding. Through the core is an axially disposed circular passage into which is positioned and sealed with a suitable mastic a hollow cylindrical sleeve of a non-magnetizable material having one closed end aligning with the outer surface of the core. The sleeve is internally threaded for receiving a like threaded shaft of non-magnetizable material containing a tube core of a magnetizable material. Rotation of the shaft adjusts the location of the tube core so as to adjust the inductance of the coil when energized.

2 Claims, 3 Drawing Figures

ADJUSTABLE-INDUCTANCE ELECTRIC COIL

BACKGROUND OF INVENTION

1. Field of Invention

This invention relates to electric coils having means for providing adjustment of the inductance produced by the coil when energized.

2. Description of the Prior Art

In electric coils having means whereby the inductance produced by the coil can be varied, heretofore, used an interior threaded sleeve into which was threadedly disposed an adjustable core. Rotation of the core changed its location to vary inductance. Securing the threaded sleeve within the coil was cumbersome in that the internal threads within the sleeve could easily become contaminated with mastic, solder or like material for securing the sleeve within the coil or with other foreign matter from an external source. If the threads became contaminated with such foreign material, then rotation of the adjusting screw was impeded.

SUMMARY OF THE INVENTION

Electrical windings contained within a coil frame are surrounded by a core made of suitable magnetizable material such as ferrite. The configuration of the core may be a round pot core, RM-core, R-core, X-core or parallel-piped core. Through the center of the core is a vertical cylindrical passage into which a sleeve of a non-magnetizable material is disposed. The sleeve has a hollow cylindrically-shaped body which is threaded internally and has a closed upper end. The sleeve can be provided with longitudinal spaced ribs on its outer surface for engaging the cylindrical passage within the core. The sleeve is then sealed within the passage using a suitable mastic such as an epoxy such that the closed or upper portion of the sleeve is aligned with the top horizontal surface of the core. By this structure, the inner surface of the sleeve is protected from contamination by foreign matter.

Into the sleeve is threaded an end of a non-magnetizable shaft carrying a tube core made of a magnetizable material. The other end of the shaft is slotted for engaging a suitable tool. Rotation of the shaft causes a change in position of the tube core which in turn causes the magnitude of the inductance produced by the coil to be changed when the coil is energized.

DESCRIPTION OF THE PREFERRED EMBODIMENT

Figure 1:
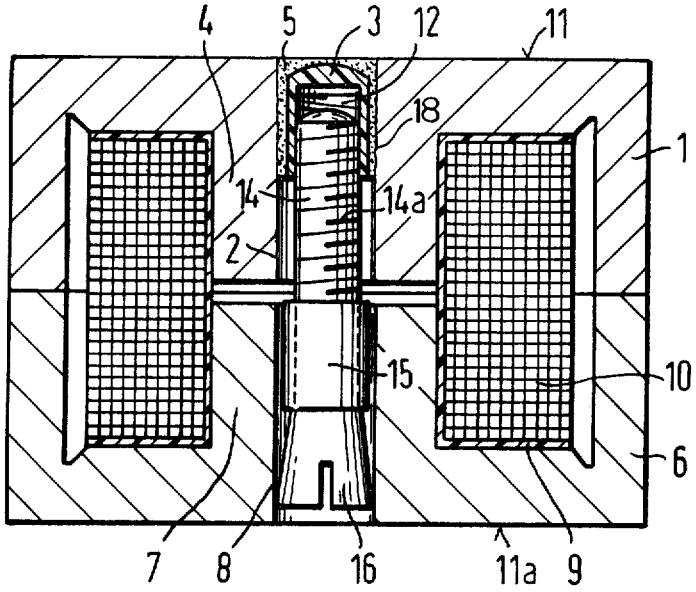
FIG. 1 is a cross-sectional view through an assembled electrically energizable coil.

An electrical coil with means for adjusting the inductance produced by the coil when energized as shown in FIG. 1. The coil comprises a top core portion 1 having a central portion 4 and a lower core portion 6 having a like central portion 7 but inverted such that the circle like outer surface of the core portion 1 and 6 serves as a top 11 and bottom 11*a* respectively of the coil. Through the upper core portion 1 and the lower core portion 6 is an axially disposed vertical cylindrical passage 2 and 8 respectively.

The upper core portion 1 and the lower core portion 6 mate to define a circumferent space formed by parts of the inner surfaces of the core portions and the central portions in which space a coil frame 9 and windings 10 are disposed. Into the cylindrical passage 2 in the upper core portion 1 is disposed a sleeve 3 having a hollow cylindrical body, a threaded interior surface and an upper closed end. The closed end is formed having a slight crown or being upwardly concaved. The sleeve 3 is so positioned within the passage 2 that the top of the crowned closed end of the sleeve 3 is aligned with the top horizontal surface 11 of the upper core portion 1.

Figure 3:
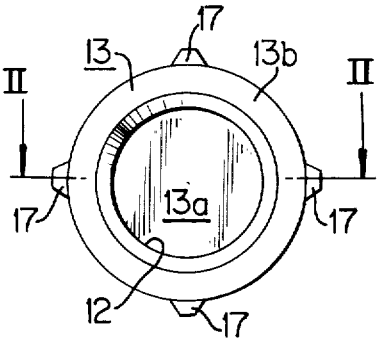
FIG. 3 is a bottom view of the alternate configuration of the sleeve used in the coil in FIG. 1 and as shown in section in FIG. 2.
Figure 2:
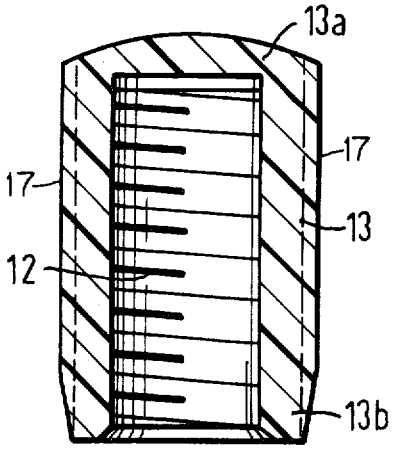
FIG. 2 is a cross-sectional view through an alternate configuration of the sleeve used within the coil of FIG. 1.

A sleeve 13 as shown in FIG. 2 and FIG. 3 may be provided with intermittently spaced vertical ribs 17 along its outer cylindrical surface such that the ribs interface with the cylindrical passage 2 in the upper core portion 1.

The sleeve 3 then is cemented into the passage 2 in the upper core portion 1 by use of a suitable mastic 5. The joint formed by the mastic 5, the sleeve 3 and the passage 2 as shown at 18 can be improved by roughening the surface of the passage 2 and the sleeve 3.

A particularly useful mastic material is a two component epoxy type which, because of its hardening and curing properties, creates an excellent interfacing material between the non-magnetic sleeve 3 which has a different coefficient of expansion than that of the magnetic upper core portion 1. Because the rate of cure of the epoxy material can be controlled by the amount of catalyst mixed with it as well as the viscosity of the material controlled by heat, the mastic may be added such that it will harden upon approximately equaling an elevation equal to that of the bottom end of the sleeve 3 when applied at the top of the sleeve 3. The mastic 5 fills the space created by the crowned top of the sleeve 3 so that the top horizontal surface 11 is flush and continuous.

Into the sleeve 3 is disposed an adjusting inductance member 14*a* comprising a core shaft 14 which is threaded to mate with internal threads 12 provided within the sleeve 3. Positioned on the shaft 14 is a tube core 15 made of a magnetizable material. To the other end of the shaft 14 is joined a non-magnetizable tool engaging end portion 16 having a tool engaging slot.

In FIG. 2 and FIG. 3 is shown an alternate configuration of a crowned sleeve 13 having a closed end portion 13*a* and a threaded interior 12 prepared for the disposition of an adjustable inductance member. The lower portion 13*b* of the sleeve 13 has a slightly bevelled exterior surface which provides a guiding means to allow the sleeve to be more easily inserted into a cylindrical passage in a core portion. Intermittently spaced about the peripheral surface of the sleeve 13 are four vertical ribs 17 so dimensioned to fit within the passage 2 of the upper core portion 1. When the sleeve 13 is used instead of the sleeve 3, the mastic 5 fills the spaces created between the ribs 17 to form a continuous cross section.

Inductance may be roughly and finely adjusted by the user. A rough adjustment may be made by removing the shaft 14 from the coil and adjusting the location of the tube core 15 on the shaft 14. The shaft is then repositioned in the coil to engage the core sleeve 3. A fine adjustment can then be made by rotating the shaft 14 with a suitable tool engaged in the slot.

While various modifications may be suggested by those versed in the art, it should be appreciated that I wish to embody within the scope of the patent warranted herein all such modifications as reasonably and properly come within the scope of my contribution to the art.

I claim as my invention:

1. In an adjustable inductance electrical coil including:

1. a fixed core body formed of a magnetizable material and having an upper and a lower core portion, each core portion having a substantially double U-shaped cross-sectional configuration which includes an outer leg and a shorter inner leg extending from a wall thereof, a free end of each outer leg of one core portion abutting against a free end of a respective outer leg of the outer core portion so as to define a lateral passage within said core body, said core portions each having a circumferential space between said inner and outer legs thereof and an axial passage located between the respective inner legs of a core portion extending from a wall thereof to the free end of said inner legs thereof, said axial passage and circumferential space of a core portion being substantially aligned with the axial passage and circumferential space of the other core portion so as to define an aligned circumferential space and an aligned axial passage within said core body;
2. a winding means positioned within said aligned circumferential space of said core body so as to create an inductance in the core upon energization of said coil; and
3. means positioned within said aligned axial passage in said core body and extending across said lateral passage for adjusting the inductance of said coil;

the improvement comprising wherein:

a. an internally threaded sleeve formed of a non-magnetizable material having an elongated cylindrical body of a length less than the length of the axial passage in said upper core portion, said cylindrical body having a crowned closed upper end portion and an opposite open end portion providing access to the interior of said sleeve, said sleeve being positioned within said axial passage in said upper core portion so that a top of said crowned closed upper end portion is substantially aligned with a top surface of said upper core portion;

b. a mastic means positioned on the outside of said sleeve between inner walls of said axial passage in said upper core portion, said crowned closed upper end portion of the sleeve and outside surface portions of said sleeve; and c. said means for adjusting the inductance of said coil consists essentially of:

$c_1$. a solid shaft formed of a non-magnetizable material having a body of a length less than the length of said aligned axial passage in said core body but greater than the length of the axial passage in said upper core portion so that said body extends from the lower core portion at least across the lateral passage in said core body, said shaft body being externally threaded at least along upper portions thereof and having a slotted tool-engageable head positioned at a select location within the axial passage in said lower core portion and having the body thereof threadedly engaged in said sleeve with an end portion of said shaft opposite the slotted head portion thereof being selectively spaced from an inner wall of said sleeve located interiorly of the crowned upper end portion thereof; and $c_2$. a hollow elongated internally threaded cylindrically-shaped tube core formed of a magnetizable material having a length less than the length of the respective axial passages in said upper and lower core portions, said tube core being threadedly engaged on said shaft at a select location thereof above the slotted head portion thereof and below said sleeve;

whereby rough inductance adjustment of the coil is attained by moving said tube core to a select location on said shaft and fine inductance adjustment of the coil is attained by moving said shaft to a select location within said sleeve.

2. In an adjustable inductance electrical coil as defined in claim 1 wherein said sleeve includes a plurality of intermittently spaced vertical ribs on the outer cylindrical surface of said sleeve, said ribs interfacing with interior walls of the axial passage in said upper core portion.

* * * * *